United States Patent [19]

Phipps

[11] 4,335,695

[45] Jun. 22, 1982

[54] CONTROL METHOD FOR INTERNAL COMBUSTION ENGINES

[75] Inventor: Jack R. Phipps, St. Clair Shores, Mich.

[73] Assignee: The Bendix Corporation, Southfield, Mich.

[21] Appl. No.: 258,159

[22] Filed: Apr. 27, 1981

Related U.S. Application Data

[63] Continuation of Ser. No. 80,367, Oct. 1, 1979, abandoned.

[51] Int. Cl.[3] ..... F02M 7/18; F02P 5/04; F02M 63/02; F02M 69/00

[52] U.S. Cl. ..... 123/478; 123/460; 123/501

[58] Field of Search ..... 123/478, 499, 472, 480, 123/486, 492, 493, 501, 458, 460

[56] References Cited

U.S. PATENT DOCUMENTS

| | | | |
|---|---|---|---|
| 2,623,509 | 12/1952 | Gold et al. | 123/460 |
| 3,796,197 | 3/1974 | Lochor et al. | 123/501 |
| 3,991,727 | 11/1976 | Kawai et al. | 123/478 |
| 4,015,572 | 4/1977 | Leshner et al. | 123/478 |

FOREIGN PATENT DOCUMENTS

| | | | |
|---|---|---|---|
| 54-22022 | 2/1979 | Japan | 123/478 |

*Primary Examiner*—Raymond A. Nelli

*Attorney, Agent, or Firm*—Markell Seitzman; Russel C. Wells

[57] ABSTRACT

A fuel control system for improving the driveability of a high power to weight ratio vehicle by using power as the controlled parameter. In the system, an operator command signal is compared to a quantity of fuel per engine revolution signal to develop an error signal proportional to the difference between actual power being delivered from the engine and operator commanded power.

2 Claims, 1 Drawing Figure

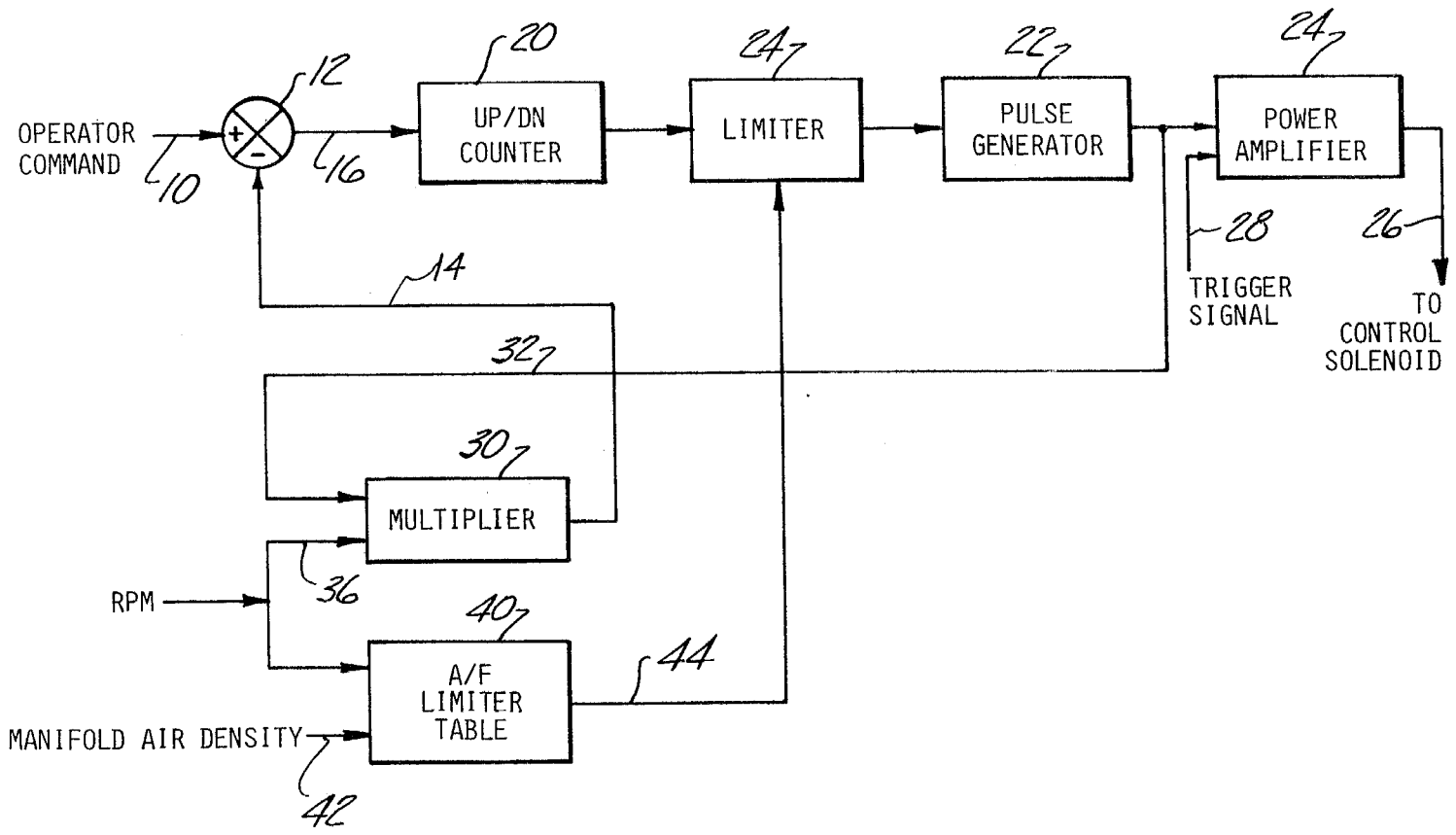
OPERATOR COMMAND
10
12
+
-
16
UP/DN COUNTER
20
14
LIMITER
24
PULSE GENERATOR
22
POWER AMPLIFIER
24
26
TO CONTROL SOLENOID
28
TRIGGER SIGNAL
32
MULTIPLIER
30
36
RPM
A/F LIMITER TABLE
40
44
MANIFOLD AIR DENSITY
42

CONTROL METHOD FOR INTERNAL COMBUSTION ENGINES

This is a continuation, of application Ser. No. 80,367, filed Oct. 1, 1979, now abandoned.

BACKGROUND OF THE INVENTION

This invention relates generally to a fuel control system and method and more particularly to a fuel control system for a vehicle having a high power to weight ratio wherein an operator commanded power signal is compared to a sensed power signal for controlling the engine response to the difference therebetween.

While the invention will be described in conjunction with a diesel-type engine, it is to be understood that the basic principles of the invention may also be applied to a spark-ignited engine. In a conventional diesel engine with an electronic fuel control including an electronic governor, the controller typically operates as a speed controller and for many purposes this type of control is entirely satisfactory. However, in a passenger car with a relatively high power to weight ratio, high relative to for example trucks, the vehicle response, or driveability, suffers somewhat with a conventional speed control device since small changes in the operator's input result in large changes in torque output of the engine.

In conventional spark ignition engines, prior to the application of severe emission control constraints and very lean operation for better fuel economy, the engines were operated in the rich regime. In such modes of operation, the torque output of the engine is proportional to manifold pressure which results from air flowing into the cylinder past the throttle plate. The throttle plate acts as a restriction to the air flowing into the engine. When the pressure across any orifice, for example the throttle plate orifice, exceeds a certain ratio to the total inlet pressure, the velocity of the air particles through the orifice become sonic. This type of flow is referred to as sonic, critical or choked flow. In that condition, the quantity of air flowing through the orifice is independent of the pressure downstream of the orifice, and is only influenced by the upstream pressure and the orifice area.

When a conventional spark ignited engine operates at heavily throttled conditions (part load), the engine is operated with a nominally constant air/fuel ratio and the power output is directly related to air flow. Since this air flow is only related to throttle area during sonic flow conditions, the power output of the engine is therefore directly related to throttle area which, in turn, is directly related to throttle rotation caused by the operator.

Such performance characteristics, the direct relationship of throttle pedal movement to power output, is considered by most drivers to represent good driveability, or to have a good response characteristic of the operation of the engine in response to a throttle change. This invention describes a method and apparatus for achieving this good driveability type power control over a wide range of throttle inputs. The description will proceed as the invention is applied to a diesel engine fuel control to improve the throttle response characteristics of the engine and make the engine generally more satisfactory to the driver without sacrificing emissions or performance characteristics.

Accordingly, it is a primary object of the present invention to improve the driveability characteristics of internal combustion engines.

Other objects, features and advantages of the present invention will become readily apparent upon analyzing this specification and the associated drawings in which the single figure of the drawing is a schematic block diagram illustrating the principles of the present invention.

DETAILED DESCRIPTION OF INVENTION

In a diesel engine which is always operated lean of stoichiometric, generally very lean, the torque output of the engine has been found empirically to be directly related to the quantity of fuel injected per cycle. Power, of course, can be derived from speed torque in the following fashion:

$$\text{Power} = K(\text{torque} \times \text{rpm})$$

where the quantity K is a proportionality constant. Therefore, in the system of the present invention, the operator input will reflect a power level requirement. Through calculation in an electronic control unit, the actual power being delivered is computed by sensing the fuel quantity being delivered and the engine speed to derive a fuel quantity per engine revolution signal and this signal is utilized to represent actual power being delivered. This computed power signal is compared to the commanded power from the operator's input to develop an error signal. The error signal drives the system to minimize the error and thereby maintain the commanded power level. Obviously, there is an upper limit for any given speed of power output for the engine. This upper limit is recognized by the control unit, the power limit being generally proportional to speed, and the amount of fuel to the engine is limited to that quantity useable by the engine. Also, smoke characteristics, stress levels, and other parameters are taken into consideration in the design of the control unit. Upon generation of the error signal, the correction process utilized in the system of the present invention operates the fuel control system to produce a suitable pulse for the fuel injectors to ensure that the operator commanded power level is achieved by the engine.

This same process can be applied to spark ignition engines with some calculation corrections due to varying air/fuel ratios, although as long as the engine is lean of stoichiometric, the torque output can still be considered directly related to the fuel input per cycle. In cases where the air/fuel ratio varies or the engine is rich of stoichiometric, thereby using up essentially all the available oxygen in the cylinder, corrections will need to be made based on manifold density parameters such as manifold pressure and temperature. Accordingly, as soon as the throttle is moved, the power level goes up in the new power point as determined by the throttle area at the new throttle position and, as the engine speed picks up, the power remains the same. Further, the torque is reduced causing the engine performance to traverse a road load curve on a torque versus engine speed graph under power control conditions.

Engines with this transient reponse characteristic are considered to have excellent driveability. However, for purpose of emission control and fuel economy, it may be desirable to omit the sharp peak which occurs when transferring from one power level to another on initial throttle change. Also, near desired speed, as represented by the new power level, the slope of the engine torque versus speed characteristic may be slightly steeper to give better road speed stability.

In the single FIGURE of the drawing there is illustrated a preferred embodiment of the present invention. Particularly, an operator command signal representative of commanded power is generated on an input conductor 10. The command signal on conductor 10 is representative of the power level desired by the operator as commanded by positioning the throttle pedal. This command signal, appropriately scaled, is fed to a comparator 12 as one input thereof. The other input to the comparator is a fuel quantity per engine revolution signal which has been generated on input conductor 14. The signal on conductor 14 is representative of the power being generated by the engine and will be explained more clearly hereafter. In the event the power commanded by the operator, as represented by the signal and conductor 10, and the power being generated by the engine, as represented by the signal on conductor 14, are different, an error signal is generated on conductor 16 which is representative of the difference of power between the two input signals.

The signal on conductor 16 is fed to an up-down counter 20 having a set count therein, which signal increments or decrements the counter depending on the polarity of the signal on conductor 16. The output of the counter 20 is fed to a pulse generator 22 through a limiter 24. The limiter is utilized to limit the maximum signal which can be fed to the pulse generator. The output of the pulse generator 22 is a fuel pulse signal which is fed to the injector by means of a power amplifier 24 and an output conductor 26. The output signal to the injector solenoid connected to conductor 26 is controlled by a trigger pulse generated by the electronic control unit and fed to input conductor 28.

The feedback circuit to generate the actual power signal on conductor 14 includes a multiplier circuit 30having plural inputs, one of which is a fuel pulse width signal on conductor 32. This signal is the pulse width signal fed out of the pulse generator, the duration of which is representative of fuel quantity for that particular fuel pulse. This signal is multiplied by an engine speed signal fed to the other input of multiplier 30 by means of a conductor 36 which is connected to an engine speed sensor. Thus, the output of multiplier 30 is representative of the quantity of fuel being fed to the engine. As was seen from the description above, this fuel quantity is directly related to the power being generated by the engine.

The limiter circuit 24 is provided an input from an air/fuel limiter table storage means 40 which is provided engine speed inputs from the input signal on conductor 36 and a mass air density signal from a mass air density sensor connected to input conductor 42. thus, the combination of the engine speed and mass air density signals provides an output signal on conductor 44 which dictates the maximum pulse width that can be generated by the pluse generator 22. The limiter acts to limit the maximum signal to which the up/down counter 20 can be incremented.

In operation, the operator changes throttle position and, for example, increases the throttle angle. This changes the input signal on conductor 10 and creates an error signal out of comparator 12 due to the fact that the signal on conductor 14 represents the previous power setting. The error signal changes the count in counter 20 to increase the pulse width of the signal out of amplifier 24. This is true as long as the limit of table storage means 40 is not exceeded.

Accordingly, it is seen that a fuel control system and method has been described to control fuel being fed to an engine in accordance with the desired power from the engine. While the signal attained by multiplying the fuel pulse width and engine speed is not exactly equal to engine power, it is obviously monotonically related to engine power in a straight-forward fashion. This multiplication of the two signals is adequate for the purposes of the power control scheme in order to produce a preferred level of driveability. Modifications to the circuit may be made to refine the control scheme or change the manner in which the data signals are processed without departing from the scope of the invention. For example, a time delay mechanism in the feedback circuit may be provided between the pulse generator 22 and the multiplier 30 to maintain stability of the system. Also, the system could be modified to incorporate the air/fuel ratio limiter into the operators input command signal circuitry so that the operator's commanded power signal would be a percent of the maximum or limit fuel per cycle which could be fed the engine. Accordingly, the appended claims should be given a broad scope of interpretation.

What I claim is:

1. A method of controlling the fuel being delivered to an internal combustion engine in accordance with the operator desired power to be delivered from the engine and improving the operator perceived operation of the engine comprising the steps of generating an operator power command signal in response solely to an operator command, sensing the power being delivered by the engine by sensing the speed and the fuel being delivered to the engine and generating a power signal representative of the quantity of fuel being delivered to the engine per engine revolution, comparing the commanded power signal with the sensed delivered fuel per revolution power signal and generating an error signal representative of the difference between the commanded power and sensed fuel delivery power signal, changing the fuel being delivered to the engine to drive the error signal toward zero and limiting the maximum fuel to be fed to the engine by sensing the engine speed and air density of air being fed to the engine and generating a limiting signal in response to addressing a limiter table with said sensed engine speed and said air density, and limiting the fuel being fed to the engine per engine revolution in response to the output of the limiter table.

2. A system for controlling the fuel being delivered to an internal combustion engine in accordance with the operator desired power to be delivered from the engine and improving the operator perceived operation of the engine comprising means for generating an operator power command signal in response to an operator command, means for sensing engine speed and the fuel being delivered to the engine and generating a power signal representative of the power being delivered from the engine per engine revolution as a function of the quantity of fuel being delivered to the engine per engine revolution, means connected to both said sensing means and said operator power command signal generating means for comparing the commanded power with the sensed power signal and generating an error signal representative of the difference between the commanded and sensed power signal, means connected to said comparing means for changing the fuel being delivered to the engine to drive the error signal toward zero and limiting the maximum fuel to be fed to the engine, said limiting means including said means for sensing engine speed and means for sensing air being fed the engine, a limiter table circuit for generating a limiting signal in response to said sensed speed and air, limiting means for limiting the fuel in response to said limiting signal.

* * * * *